US005163724A

United States Patent [19]

Conte

[11] Patent Number: 5,163,724

[45] Date of Patent: Nov. 17, 1992

[54] VEHICLE TRUNK COMPARTMENT LID HOLDER

[76] Inventor: Daniel Conte, 28 Wedgewood Dr., Goshen, N.Y. 10924

[21] Appl. No.: 791,310

[22] Filed: Nov. 14, 1991

[51] Int. Cl.[5] ..... E05B 65/19; E05C 17/54

[52] U.S. Cl. ..... 292/258; 292/DIG. 43; 292/262; 292/339; 269/249; 269/45; 269/97

[58] Field of Search ..... 292/262, 339, DIG. 43, 292/258, 289, 288; 269/258, 249, 45, 97

[56] References Cited

U.S. PATENT DOCUMENTS

| | | | |
|---|---|---|---|
| 2,019,789 | 11/1935 | Mahannah | 292/258 |
| 2,916,902 | 12/1959 | Wamsley | 70/93 |
| 2,919,946 | 1/1960 | Miener | 292/288 |
| 2,973,217 | 2/1961 | Gregoire | 292/288 |
| 2,974,989 | 3/1961 | Hilbers | 292/339 |
| 3,180,668 | 4/1965 | Brown | 292/258 |
| 3,216,605 | 11/1965 | Hughes | 292/DIG. 43 |
| 3,306,656 | 2/1967 | Hughes | 296/76 |
| 3,674,299 | 7/1972 | Kelley | 292/262 |
| 3,988,032 | 10/1976 | Weinstein | 296/76 |
| 4,062,583 | 12/1977 | Taylor | 296/76 |
| 4,070,050 | 11/1978 | Glock et al. | 292/339 |
| 4,089,513 | 5/1978 | Mack | 269/97 |
| 4,124,240 | 11/1978 | Adelberg | 292/339 |
| 4,169,562 | 10/1979 | Renzetti | 269/97 |
| 4,188,061 | 2/1980 | Shehi | 296/76 |
| 4,307,907 | 12/1981 | Barrowman et al. | 292/339 |
| 4,943,039 | 7/1990 | Jackson | 269/97 |

*Primary Examiner*—Eric K. Nicholson
*Attorney, Agent, or Firm*—Abdallah & Muckelroy

[57] ABSTRACT

A vehicle trunk compartment lid holder to retain the trunk lid in selective partially-opened positions. The trunk lid holder includes an L-shaped central bar member, a first clamp slidably and rotatably attached to the vertical leg of the central bar member, and a second clamp rotatably attached to the horizontal leg of the central bar member. The first clamp selectively engages the trunk lid and the second clamp selectively engages the body of the trunk compartment. First clamp can be selectively locked at various positions along the vertical leg of the central bar member.

11 Claims, 3 Drawing Sheets

Fig. 1
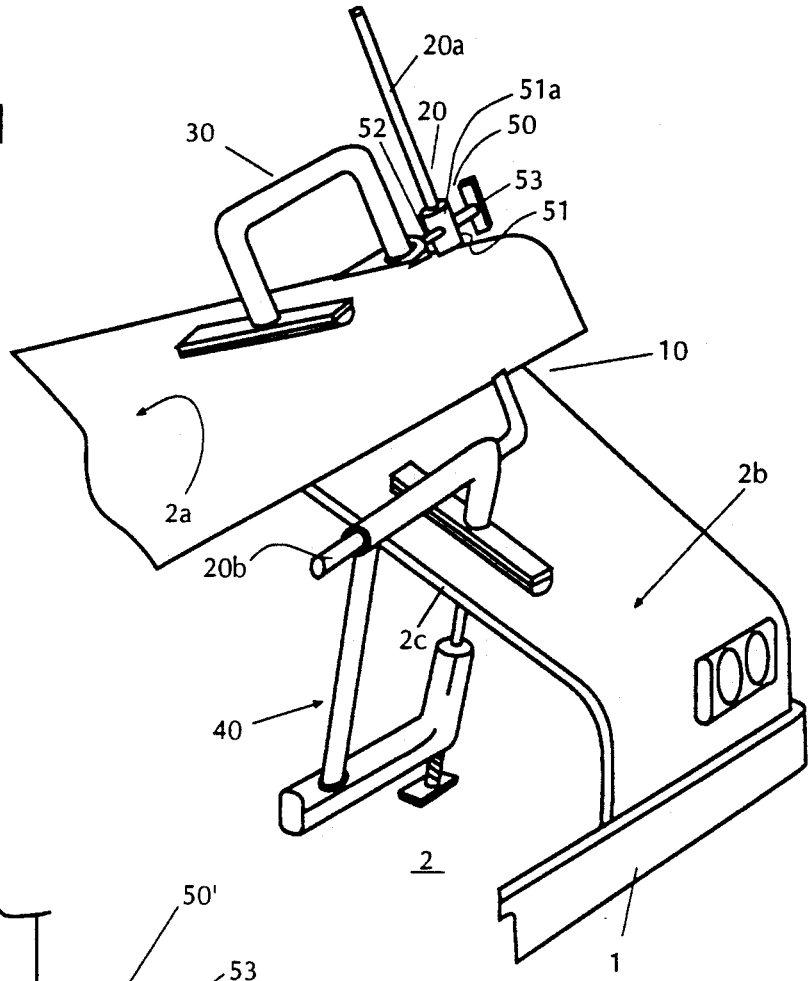
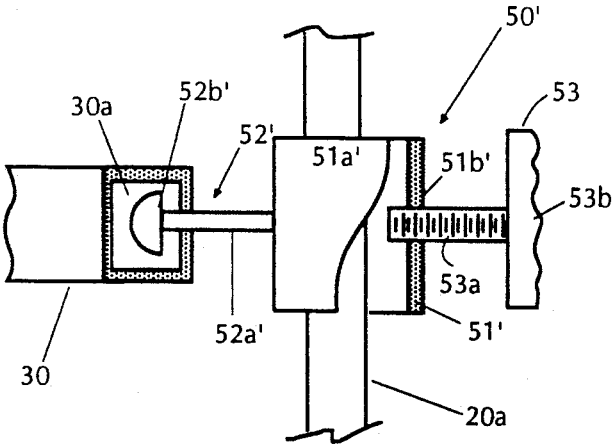
Fig. 2
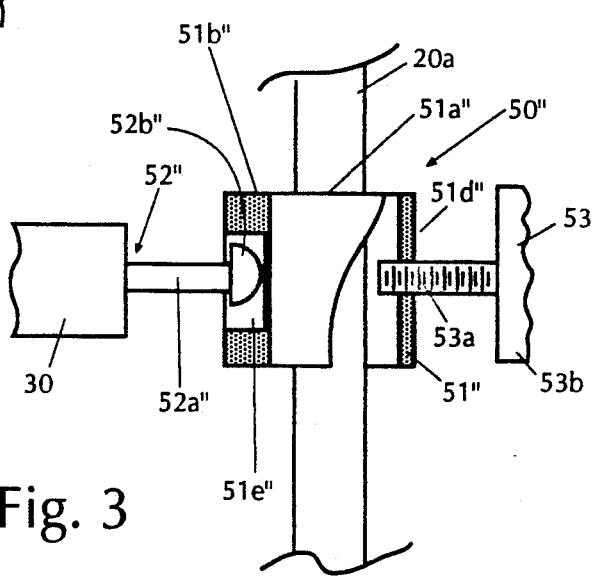
Fig. 3

VEHICLE TRUNK COMPARTMENT LID HOLDER

BACKGROUND OF THE INVENTION

The present invention generally relates to devices for holding the lid of a vehicle trunk compartment in a partially-opened position. More specifically, this invention relates to a selectively-attachable device for holding a vehicle trunk compartment lid in selective partially-opened positions.

Vehicle trunk compartment lids generally only remain fixed at either a fully-closed position or a fully-opened position. It has long been recognized that a vehicle trunk compartment is also useful with the trunk compartment lid disposed in a partially-opened position, for example, when transporting an oversized load.

A common method of retaining a trunk compartment lid in a partially-opened position is to attach one end of a rope or other flexible cord, such as a bungie cord, to the trunk lid and the opposite end of the rope to the vehicle bumper or other part of the vehicle body. Several limitations are inherent to this method of retaining a trunk compartment lid in a partially-opened position. Firstly, rope or cord generally cannot be drawn sufficiently taut to prevent the trunk lid from bouncing against an oversized load during transport. Secondly, the strength required to tightly draw a rope or cord against an oversized load prevents many people from using this method, in particular women, children and the elderly. Also, the design of many vehicles only permits attachment of a rope or cord at or near the trunk compartment lock thereby subjecting the lock to potential damage. Fourthly, a rope or cord attached to the rear portion of a partially-opened trunk compartment limits the clear, open space available for rearwardly-projecting loads.

In addition to a rope or cord other types of vehicle trunk lid holders are known in the prior art. These devices also fail to overcome one or several of the foregoing and other limitations inherent to a rope or cord used to retain a trunk lid in a partially-opened position. Prior art trunk lid holders generally fall into two categories: (1) devices that are fixedly attached to a vehicle and (2) devices that are selectively attachable to a vehicle.

A fixedly attached trunk lid holder is shown in U.S. Pat. No. 2,916,902 to Wamsley. The Wamsley trunk lid holder generally comprises a selectively adjustable rope or cable disposed between respective anchor plates that are fixedly attached to each side of the floor of a vehicle trunk compartment. The rope or cable extends between the respective anchor plates via hooks attached to the trunk compartment lid. In U.S. Pat. No. 3,988,032 to Weinstein a pair of anchors are fixedly attached to the floor of a vehicle trunk compartment and to the trunk compartment lid, respectively. A selectively adjustable strap means extends between the respective anchors. In U.S. Pat. No. 4,062,583 to Taylor a telescopic brace unit is fixedly attached at respective ends in pivoting engagement to a trunk compartment lid and to the floor of the trunk compartment. U.S. Pat. No. 4,188,061 to Shehi discloses a retractable strap fixedly attached to the floor of a vehicle trunk compartment which selectively engages a strap buckle fixedly attached to the vehicle trunk compartment lid.

A selectively attachable trunk lid holder is shown in U.S. Pat. No. 2,919,946 to Miener and comprises a resilient strap, attached at one end to a hook formation which selectively engages the underside of a vehicle bumper, and attached at the opposite end to pivotally-mounted hooks which selectively engage apertures formed in the vehicle trunk lid. U.S. Pat. No. 2,973,217 to Gregoire discloses a selectively attachable vehicle trunk lid holder that includes cooperating strut and tension portions. In U.S. Pat. No. 3,306,656 to Hughes a vehicle trunk lid holder is shown comprising a pair of notched thrust members and a interconnecting the respective thrust members. The thrust members selectively receive the trunk lid within the notches formed therein with an end of each thrust member bearing against the trunk lid jamb on opposite sides of the trunk lid. The drawstring extends between the respective thrust members over the trunk lid and can be selectively tightened to retain the trunk lid in a selected partially-opened position against an oversized load.

SUMMARY OF THE INVENTION

The vehicle trunk compartment lid holder of the present invention generally comprises an L-shaped central bar member, a first clamp slidably and rotatably attached to the vertical leg of the central bar member, and a second clamp rotatably attached to the horizontal leg of the central bar member. The first clamp selectively engages the trunk lid. The second clamp selectively engages a portion of the vehicle adjacent to the trunk lid jamb. First clamp can be selectively locked at various positions along the vertical leg of central bar member to retain a trunk compartment lid in a selective partially-opened position.

An object of the present invention is to provide means to retain a vehicle trunk compartment lid stationary in selective, partially-opened positions.

Another object of this invention is to prevent bouncing and vibrating of a vehicle trunk lid when transporting a load with the trunk lid disposed in a partially-opened position.

Another object of this invention is to provide means to hold a vehicle trunk compartment lid in a partially-opened position while retaining a clear, open space to the rear of the trunk compartment.

A further object of the present invention is to provide a selectively attachable vehicle trunk compartment lid holder that can be easily handled and stored.

It is also an object of the present invention to provide a trunk lid holder that can be used with any trunk compartment and by virtually any person.

Another object of the present invention is to provide a trunk lid holder that is universally adjustable to any partially-opened positions of a vehicle trunk compartment lid.

A still further object of this invention is to provide a trunk lid holder that can be easily and readily attached to a vehicle trunk lid without using any tools other than the human hand.

It is also an object of this invention to provide a trunk lid holder that can be selectively positioned using one hand only and secured in various positions by a single holder locking means.

These and other objects and advantages of the vehicle trunk compartment lid holder of the present invention will be apparent to those skilled in the art from the following description of preferred embodiments, claims and appended drawings.

BRIEF DESCRIPTION OF THE DRAWINGS

FIG 1 is a top perspective view of a first preferred embodiment of the vehicle trunk compartment lid holder of the present invention illustrating attachment of the trunk lid holder to a vehicle.

FIG. 2 is a side elevational view of a first embodiment of a first swivel lock in accordance with the teachings of the present invention shown partially in cross-section.

FIG. 3 is a side elevational view of a second embodiment of a first swivel lock in accordance with the teachings of the present invention shown partially in cross-section.

DESCRIPTION OF PREFERRED EMBODIMENTS

Figure 4:
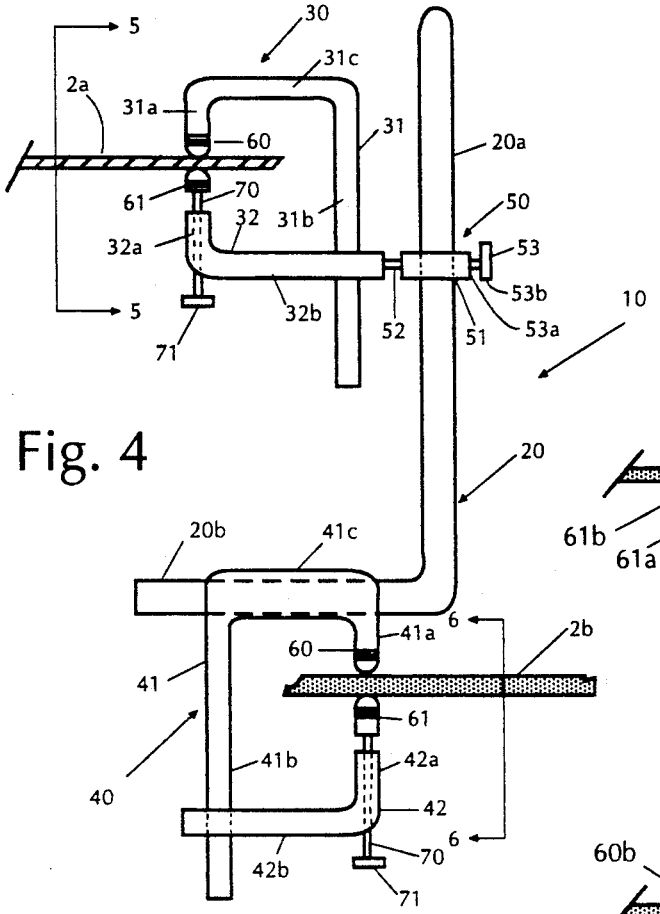
FIG. 4 is a side elevational view of the first preferred embodiment of the vehicle trunk compartment lid holder of the present invention.

FIG. 1 illustrates in a top perspective view the attachment of a first preferred embodiment of the vehicle trunk compartment lid holder 10 of the present invention to a vehicle 1 for retention of the vehicle trunk compartment lid 2*a* in a partially-opened position. In FIG. 1, a single first trunk compartment lid holder 10 is shown attached to the right side of a trunk compartment 2, however as will be understood from the present disclosure first trunk lid holder 10 may be attached to either or both the right and the left side of the trunk compartment 2.

First trunk lid holder 10 generally comprises an L-shaped first central bar member 20, preferably a ⅜"-diameter rod, a first clamp 30 attached to the vertical leg 20*a* of first central bar member 20, and a second clamp 40 attached to the horizontal leg 20*b* of first central bar member 20. First clamp 30 selectively engages trunk compartment lid 2*a* and second clamp 40 selectively engages a portion of the trunk compartment body 2*b* adjacent to the trunk lid jamb 2*c*. First trunk lid holder 10 can be positioned and attached to various portions of the trunk lid 2*a* and the trunk compartment body 2*b* to facilitate disposition of trunk lid 2*a* in various selective partially-opened positions.

First clamp 30 is slidably and rotatably attached to the vertical leg 20*a* of first central bar member 20 by means of a first swivel lock 50 as hereinafter described in greater detail. Second clamp 40 slidably receives in rotatable engagement the horizontal leg 20*a* of first central bar member 20.

First swivel lock 50 permits first clamp 30 to be slid up and down the vertical leg 20*a* of first central bar member 20 and selectively locked at various positions thereon. First swivel lock 50 also provides means for free rotation of first clamp 30 parallel to the vertical leg 20*a* of first central bar member 20. First swivel lock 50 generally comprises an annular ring 51, a swivel lock stem 52 extending laterally from a side wall 51*a* of annular ring 51 to first clamp 30, and a locking bolt 53 threadedly receivable in annular ring 51. Annular ring 51 slidably receives the vertical leg 20*a* of first central bar member 20. Locking bolt 53 is formed having a threaded locking bolt stem 53*a* and a knurled locking bolt head 53*b*, and as best seen in FIGS. 2 and 3 locking bolt stem 53*a* threadedly engages the side wall 51*a* of annular ring 51 opposite to the swivel lock stem 52 for selective locking of annular ring 51 and the attached first clamp 30 to vertical leg 20*a* by bearing engagement of an end of stem 53*a* against vertical leg 20*a*. The parallel rotation of first clamp 30 relative to vertical leg 20*a* can be accomplished by at least two different constructions of first swivel lock 50 as illustrated in FIGS. 2 and 3.

A first embodiment 50' of first swivel lock 50 is illustrated in FIG. 2. The first embodiment 50' of first swivel lock 50 includes a locking bolt 53, a first annular ring 51' having an opening 51*b'* formed in a side wall 51*a'* thereof for threaded receipt of locking bolt 53, and a first swivel lock stem 52'. First swivel lock stem 52' includes a lock stem body 52*a'* and a lock stem head 52*b'* fixedly attached to one end of lock stem body 52*a'*. The opposite end of lock stem body 52*a'* is fixedly attached to first annular ring 51'. Lock stem head 52*b'* is rotatably received and retained in a clamp cavity 30*a* formed in a portion of first clamp 30.

A second embodiment 50" of first swivel lock 50, illustrated in FIG. 3, includes a locking bolt 53, a second annular ring 51", and a second swivel lock stem 52". Second annular ring 51" is formed having a leg receptacle portion 51*a"* and a stem anchor portion 51*b"*. The vertical leg 20*a* of the first central bar member 20 is slidably received in the leg receptacle portion 51*a"* of second annular ring 51". Locking bolt 53 threadedly engages a side wall 51*c"* of the leg receptacle portion 51*a"* through an opening 51*d"* formed therein for selective locking of annular ring 51" to vertical leg 20*a* as heretofore described. Second swivel lock stem 52" is formed having a lock stem body 52*a"* and a lock stem head 52*b"* fixedly attached to one end of lock stem body 52*a"*. The opposite end of lock stem body 52*a"* is fixedly attached to first clamp 30. Lock stem head 52*b"* is rotatably received and retained in a stem anchor cavity 51*e"* formed in the stem anchor portion 51*b"* of second annular ring 51".

From the foregoing it should be understood that in more general terms swivel lock stem 52 is fixedly attached at one end and rotatably attached at the opposite end between first clamp 30 and annular ring 51.

Referring now to FIG. 4 first clamp 30 can be better seen to generally comprise a first clamping arm 31 and a second clamping arm 32. First clamping arm 31 is preferably a substantially U-shaped, bent rod member having a first short leg 31*a* and a first long leg 31*b* integrally formed at 90° bends at the respective ends of a first central portion 31*c*. A first rubber-tipped engagement pad 60 is fixedly attached at the distal end of first short leg 31*a* of first clamping arm 31. Second clamping arm 32 is preferably an L-shaped bent rod member having a second short leg 32*a* and a second long leg 32*b*. A bearing engagement rod 70 having a rod handle 71 threadedly engages a central longitudinal bore formed in the second short leg 32*a* of second clamping arm 32. A second rubber-tipped engagement pad 61 is attached in omni-directional rotational engagement to the distal end of bearing engagement rod 70. The term "omni-directional rotational engagement" means that pad 60 can be rotated in all directions on the end of first bearing engagement rod 70. The first long leg 31*b* of first clamping arm 31 is slidably received laterally in the second long leg 32*b* of second clamping arm 32, whereupon the respective first and second engagement pads 60, 61 are vertically aligned. The distal end of the second long leg 32*b* is attached to the swivel lock stem 52 of swivel lock 50 in either of the manners heretofore described. Trunk compartment lid 2*a* is selectively received and retained between the first engagement pad 60 and the second engagement pad 61 as hereinafter described in greater detail.

Second clamp 40 likewise generally comprises a first clamping arm 41 and a second clamping arm 42. The first clamping arm 41 of second clamp 40 is formed as a substantially U-shaped member having a first short leg 41*a* and a first long leg 41*b* integrally formed at 90° bends at the respective ends of a second central portion 41*c* thereof. As previously described, a first engagement pad 60 is fixedly attached to the distal end of first short leg 41*a*. Second clamping arm 42, preferably an L-shaped bent rod member having a second short leg 42*a* and a second long leg 42*b*, slidably receives the first long leg 41*b* of second clamp 40 laterally within the second long leg 42*b* thereof. Similar to first clamp 30, a bearing engagement rod 70, having a rod handle 71 fixedly attached at one end thereof and a second bearing engagement pad 61 attached in omni-directional rotational engagement at the opposite end thereof, threadedly engages a central longitudinal bore formed in second short leg 42*a* of second clamping arm 42. The second central portion 41*c* of the first clamping arm 41 slidably receives the horizontal leg 20*b* of first central bar member 20 in rotatable engagement. Trunk compartment body 2*b* is selectively received and retained between the respective first and second engagement pads 60, 61 of second clamp 40.

Figure 5:
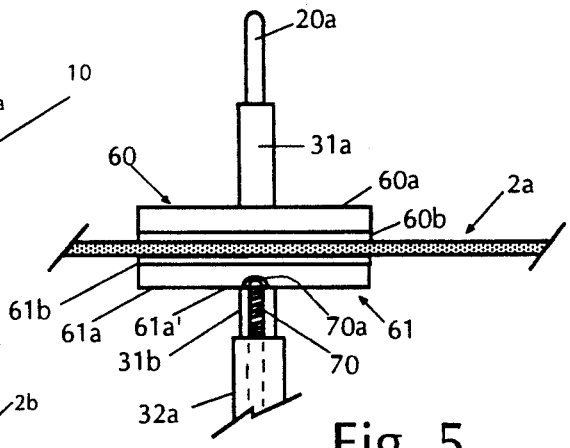
FIG. 5 is a partially-fragmented end elevational view of the first trunk compartment lid holder taken along line 5—5 of FIG. 4.
Figure 6:
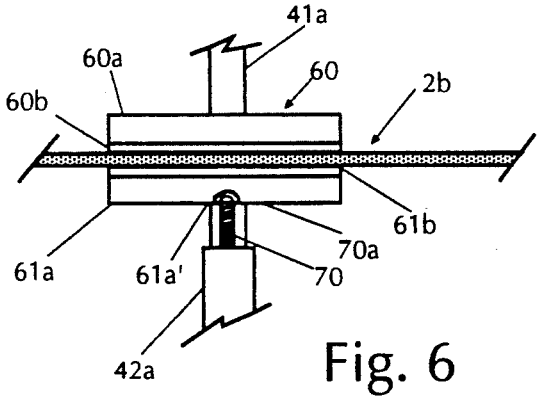
FIG. 6 is a partially-fragmented end elevational view taken along line 6—6 of FIG. 4.

FIGS. 5 and 6, elevational views taken along line 5—5 and line 6—6 of FIG. 4, respectively, illustrate in greater detail the construction and attachment of the first and second engagement pads 60, 61 to the trunk lid 2*a* and the trunk compartment body 2*b*. The respective first and second engagement pads 60, 61 are preferably formed as laterally-extending blade members, respectively comprising a pad support portion 60*a*, 61*a* and a rubber tip portion 60*b*, 61*b* fixedly attached to the respective pad support portions 60*a*, 61*a*. First and second engagement pads 60, 61 preferably extend laterally for a distance of approximately four inches. The first short leg 31*a* (or second short leg 41*a*) of first clamp 30 (second clamp 40) is fixedly attached to a central portion of the pad support portion 60*a* of first engagement pad 60. The distal end 70*a* of bearing engagement rod 70 is formed as a convex surface and is received in fixed, rotatable engagement in a concave recess 61*a*′ formed in a central portion of the pad support portion 61*a* of second engagement pad 61.

Figure 7:
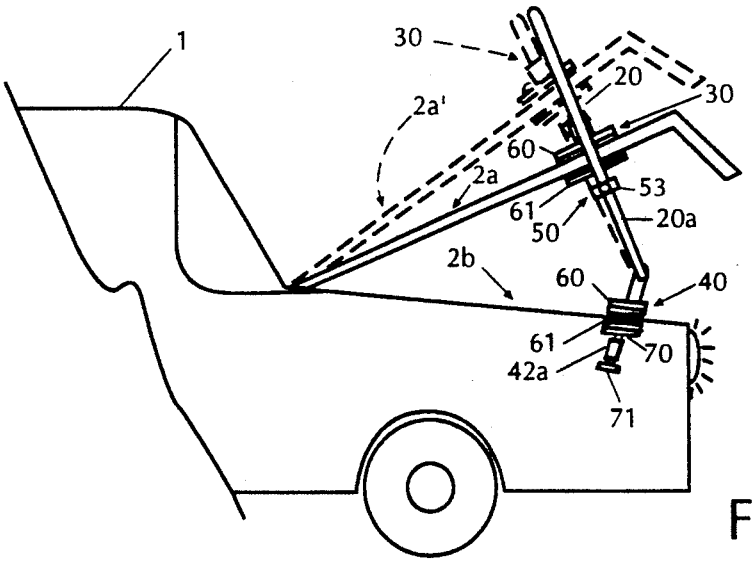
FIG. 7 is a side elevational view of a vehicle illustrating the selective attachment of the first trunk lid holder for disposition of a trunk lid at varying positions.

The operation of the first trunk lid holder 10 of the present invention to retain a vehicle trunk lid 2*a* in selective partially-opened positions can be fully understood by reference to FIG. 7. A portion of the trunk compartment body 2*b* is first secured between the respective first and second bearing engagement pads 60, 61 of second clamp 40. Then with the locking bolt 53 of first swivel lock 50 loosened trunk lid 2*a* is secured between the respective first and second engagement pads 60, 61 of first clamp 30. The respective first and second engagement pads 60, 61 are brought into close-fitting bearing engagement with the trunk lid 2*a* and the trunk compartment body 2*b* by turning the respective rod handles 71 to threadedly extend rod 70 through the respective short legs 32*a*, 42*a*. The trunk compartment body 2*b* of a vehicle 1 is generally sloped downwardly from front to rear and thus second clamping arm 42 of second clamp 40 is angularly disposed from the vertical when second clamp 40 is fixedly attached to trunk compartment body 2*b*. Second clamping arm 42 of second clamp 40 is therefore prevented from sliding from the long leg 41*b* of the first clamping arm 41 of second clamp 40 under the influence of gravity by the frictional engagement of first clamping arm long leg 41*b* with the second clamping arm long leg 42*b* (FIG. 4). Trunk lid 2*a* is then raised to a first selective partially-opened position as illustrated by the solid lines 2*a* in FIG. 7 whereby first clamp 30 slides upwardly along the vertical leg 20*a* of first central bar member 20 as first central bar member 20 also rotates in the central portion 41*c* of the first clamping arm 41 of second clamp 40. Locking bolt 53 is then tightened by turning the locking bolt head 53*b* to bring locking bolt stem 53*a* in bearing engagement with the vertical leg 20*a* of first central bar member 20, thus securing trunk lid 2*a* in the selective position.

Trunk lid 2*a* can be raised to a second selective partially-opened position as indicated by the phantom lines 2*a*′ in FIG. 7 without removing first trunk lid holder 10 from the vehicle 1. Locking bolt 53 is loosened and trunk lid 2*a* is raised or lowered to the second selective position. Locking bolt 53 is then tightened to secure trunk lid 2*a*′ in place. The parallel rotation of first clamp 30 relative to vertical leg 20*a* and the rotational engagement of first central bar member 20 to second clamp 40 permits the re-positioning of trunk lid 2*a* without removing trunk lid holder 10. As trunk lid 2*a* is raised, for example, first clamp 30 is free to rotate to assume the new angular positioning of trunk lid 2*a*′ as first clamp 30 is moved up the vertical leg 20*a* of first central bar member 20. Vertical leg 20*a* is also free to rotate via the rotational engagement of the horizontal leg 20*b* of first central bar member 20 in the central portion 41*c* of the first clamping arm 41 of second clamp 40. Thus, as the trunk compartment 2 is sequentially loaded or unloaded, for example, trunk lid 2*a* can be moved accordingly and locked by single-hand turning of locking bolt 53 in the new selective partially-opened position without removing first trunk lid holder 10 from the vehicle 1.

Figure 8:
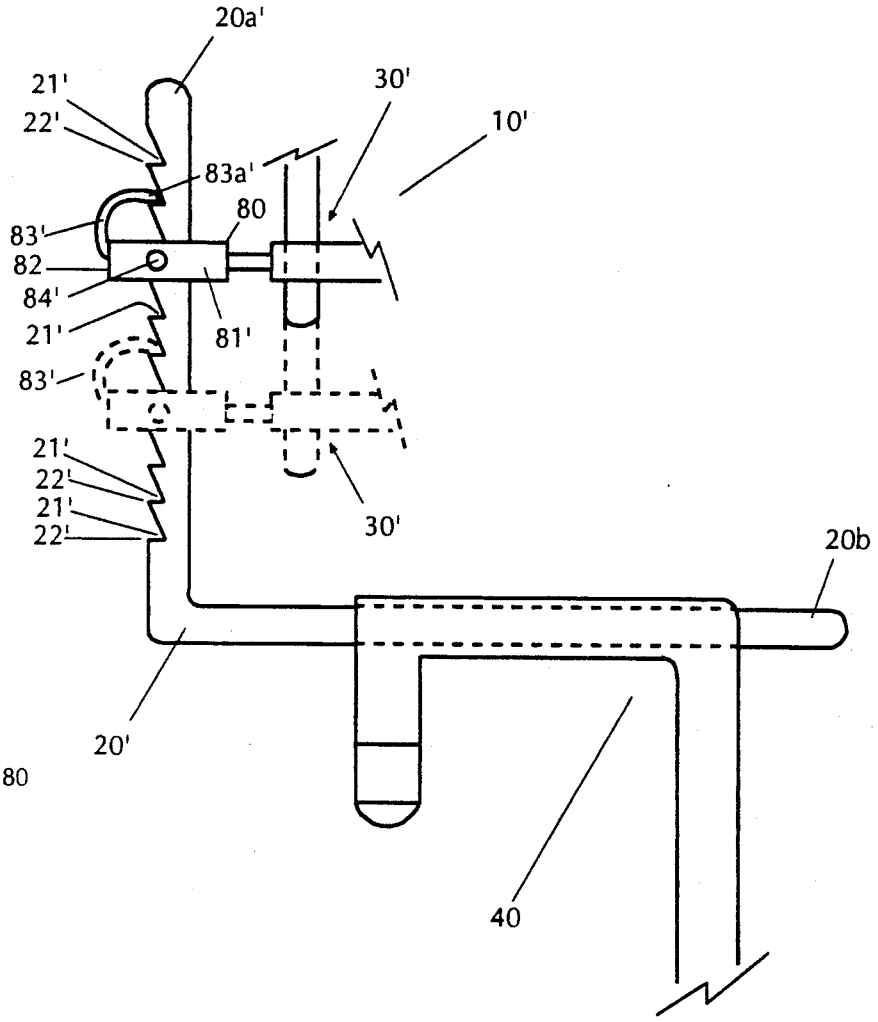
FIG. 8 is a fragmented side elevational view of a second preferred embodiment of the trunk compartment lid holder of the present invention.
Figure 9:
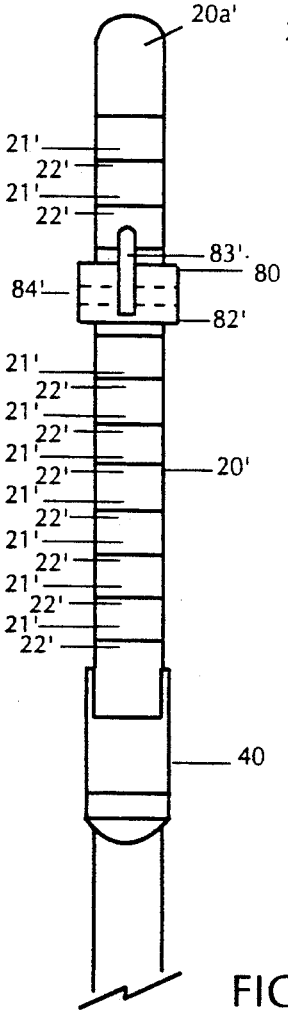
FIG. 9 is an end elevational view of the second trunk lid holder shown in FIG. 8.

A second preferred embodiment of a trunk lid holder 10′ constructed in accordance with the teachings of the present invention is illustrated in a fragmented elevational view in FIG. 8. Second trunk lid holder 10′ is constructed substantially similar to first trunk lid holder 10 having a second L-shaped central bar member 20′, a second swivel lock 80′, a first clamp 30 and a second clamp 40. Second central bar member 20′ is formed having a second vertical leg 20*a*′ and a horizontal leg 20*b*. Second vertical leg 20*a*′ includes a plurality of vertically displaced cutaway portions 21′ on an outer portion thereof which form swivel lock clamping shoulders 22′ for selective engagement of second swivel lock 80′. Second swivel lock 80′ includes a vertical leg receiving portion 81′ and a hook latch portion 82′ attached to an end of the vertical leg receiving portion 81′. A hook latch 83′ is rotatably attached to a latch pin 84′ extending laterally through the hook latch portion 82′. Hook latch 83′ includes a curved head 83a′ which selectively engages the swivel lock clamping shoulders 22′ of second vertical leg 20a′ to retain the second swivel lock 80′ and the attached first clamp 30 in selective vertical positions. As illustrated in phantom lines at 30′ in FIG. 8 first clamp 30 can be selectively moved vertically along second vertical leg 20a′ and hook latch 83′ is repositioned accordingly. First clamp 30 is rotatably attached to second swivel lock 80′ as heretofore described.

Various changes, additions and modifications may be made to the preferred embodiments without departing from the spirit and scope of the present invention. Such changes, additions and modifications within a fair reading of the appended claims are intended as part of the present disclosure.

Therefore, in view of the foregoing I claim:

1. A vehicle trunk compartment lid holder comprising a central bar member;

a first clamp attached in adjustable and selectively lockable engagement to a first portion of the central bar member, said first clamp comprising a first clamping arm and a second clamping arm, said first clamping arm comprising a substantially U-shaped member having a first short leg and a first long leg integrally formed at 90° bends at respective ends of a central member portion, and said second clamping arm comprising an L-shaped member having a second short leg and a second long leg, the first long leg of said first clamping arm being slidably receivable laterally in the second long leg of said second clamping arm; and a second clamp attached in adjustable engagement to a second portion of the central bar member.

2. A vehicle trunk compartment lid holder as in claim 1 further including a first engagement pad fixedly attached at a distal end of said first short leg of said first clamping arm, and a bearing engagement rod having a rod handle attached at a proximal end of said bearing engagement rod and a second engagement pad attached in omni-directional rotational engagement to a distal end of said bearing engagement rod, said rod threadedly engaging a central longitudinal bore formed in the second short leg of said second clamping arm.

3. A vehicle trunk compartment lid holder as in claim 2 wherein said respective engagement pads are formed as laterally-extending blade members.

4. A vehicle trunk compartment lid holder as in claim 3 wherein said respective engagement pads comprise a pad support portion and a rubber tip portion fixedly attached to said pad support portion, said first short leg and said bearing engagement rod being attached and engaged respectively to respective pad support portions.

5. A vehicle trunk compartment lid holder comprising a central bar member;

a first clamp attached in adjustable and selectively lockable engagement to a first portion of the central bar member; and a second clamp attached in adjustable engagement to a second portion of the central bar member, said second clamp comprising a first clamping arm and a second clamping arm, said first clamping arm comprising a substantially U-shaped member having a first short leg and a first long integrally formed at 90° bends at the respective ends of a central member portion, and said second clamping arm comprising an L-shaped member having a second short leg and a second long leg, the first long leg of said first clamping arm being slidably receivable laterally in the second long leg of said second clamping arm, the second portion of said central bar member being slidably and rotatably receivable in the central member portion of said first clamping arm.

6. A vehicle trunk compartment lid holder as in claim 5 further including a first engagement pad fixedly attached at a distal end of said first short leg of said second clamping arm, and a bearing engagement rod having a rod handle attached at a proximal end of said bearing engagement rod and a second engagement pad attached in omni-directional rotational engagement to a distal end of said bearing engagement rod, said rod threadedly engaging a central longitudinal bore formed in the second short leg of said second clamping arm.

7. A vehicle trunk compartment lid holder as in claim 6 wherein said respective engagement pads are formed as laterally-extending blade members.

8. A vehicle trunk compartment lid holder as in claim 7 wherein said respective engagement pads comprise a pad support portion and a rubber tip portion fixedly attached to said pad support portion, said first short leg and said bearing engagement rod being attached and engaged respectively to respective pad support portions.

9. A vehicle trunk compartment lid holder comprising an L-shaped central bar member having a vertically extending leg and a horizontally extending leg, the vertically extending leg of said central bar member being formed having a plurality of vertically displaced engagement shoulders;

a first clamp attached in adjustable and selectively lockable engagement to the vertically extending leg of said central bar member; and a second clamp attached in adjustable engagement to the horizontally extending leg of said central bar member;

wherein said first clamp is attached in slidable, rotatable and selectively lockable engagement to the vertically extending leg of said central bar member by means of a swivel lock, said swivel lock including means to slidably receive the vertically extending leg of said central bar member and means to selectively engage said engagement shoulders for selective locking of said first clamp to said vertically extending leg of said central bar member;

wherein said swivel lock comprises an annular ring having a hook latch rotatably attached to said annular ring and a swivel lock stem rotatably attached at one end thereof and fixedly attached at the opposite end thereof between said annular ring and said first clamp, said hook latch being selectively engageable with the engagement shoulder formed in said vertically extending leg of central bar member.

10. A vehicle trunk compartment lid holder comprising an L-shaped central bar member having a vertically extending leg and a horizontally-extending leg;

a first clamp including a first clamping arm and a second clamping arm, said first clamping arm comprising a substantially U-shaped bent rod member having a first short leg and a first long leg integrally formed at 90° bends at respective ends of a central rod portion, and said second clamping arm comprising an L-shaped bent rod member having a second short leg and a second long leg, the first long leg of said first clamping arm being slidably receivable laterally in the second long leg of said second clamping arm, said first clamp being attached in slidable, rotatable and selectively lockable engagement to the vertically-extending leg of said central bar member by means of a swivel lock, said swivel lock comprising an annular ring, a swivel lock stem extending laterally from a side wall of said annular ring, and a locking bolt having a locking bolt stem and a locking bolt head, said locking bolt stem threadedly engaging the side wall of said annular ring, said vertically-extending leg of said central bar member being slidably receivable in said annular ring, said swivel lock stem being fixedly attached at one end thereof and rotatably attached at the opposite end thereof between said first clamp and said annular ring, said first clamp being selectively lockable to the vertically-extending leg of said central bar member by bearing engagement of an end of said locking bolt stem with said vertically-extending leg; and a second clamp including a first clamping arm and a second clamping arm, said first clamping arm comprising a substantially U-shaped member having a first short leg and a first long leg integrally formed at 90° bends at the respective ends of a central member portion, and said second clamping arm comprising an L-shaped bent rod member having a second short leg and a second long leg, the first long leg of said first clamping arm being slidably receiving laterally in the second long leg of said second clamping arm, the horizontally-extending leg of said central bar member being slidably and rotatably receivable in the central member portion of said first clamping arm.

11. A vehicle trunk compartment lid holder comprising an L-shaped central bar member having a vertically-extending leg and a horizontally-extending leg, said vertically-extending leg being formed having a plurality of vertically-displaced engagement shoulders;

a first clamp including a first clamping arm and a second clamping arm, said first clamping arm comprising a substantially U-shaped bent rod member having a first short leg and a first long leg integrally formed at 90° bends at respective ends of a central rod portion, and said second clamping arm comprising an L-shaped bent rod member having a second short leg and a second long leg, the first long leg of said first clamping arm being slidably receivable laterally in the second long leg of said second clamping arm, said first clamp being attached in slidable, rotatable and selectively lockable engagement to the vertically-extending leg of said central bar member by means of a swivel lock, said swivel lock comprising an annular ring having a hook latch rotatably attached to said annular ring and a swivel lock stem rotatably attached at one end thereof and fixedly attached at the opposite end thereof between said annular ring and said first clamp, said hook latch selectively engaging said engagement shoulders; and a second clamp including a first clamping arm and a second clamping arm, said first clamping arm comprising a substantially U-shaped member having a first short leg and a first long leg integrally formed at 90° bends at the respective ends of a central member portion, and said second clamping arm comprising an L-shaped bent rod member having a second short leg and a second long leg, the first long leg of said first clamping arm being slidably receiving laterally in the second long leg of said second clamping arm, the horizontally-extending leg of said central bar member being slidably and rotatably receivable in the central member portion of said first clamping arm.

* * * * *